US006361272B1

(12) United States Patent
Bassett

(10) Patent No.: US 6,361,272 B1
(45) Date of Patent: Mar. 26, 2002

(54) CENTRIFUGAL SUBMERSIBLE PUMP

(76) Inventor: Lonnie Bassett, 4408 Trotter, Casper, WY (US) 82604

( * ) Notice: Subject to any disclaimer, the term of this patent is extended or adjusted under 35 U.S.C. 154(b) by 21 days.

(21) Appl. No.: 09/684,434

(22) Filed: Oct. 10, 2000

(51) Int. Cl.[7] ..... F01D 25/00

(52) U.S. Cl. ..... 415/121.1; 417/423.3; 417/424.2; 417/424.14; 415/199.2

(58) Field of Search ..... 415/1, 121.2, 201, 415/118, 169.1, 199.1, 199.2, 199.3; 417/430, 313, 423.3, 423.5, 424.2, 424.14

(56) References Cited

U.S. PATENT DOCUMENTS

| | | | | |
|---|---|---|---|---|
| 2,693,760 A | * | 11/1954 | Miller | 415/214.1 |
| 2,918,016 A | * | 12/1959 | Olson | 415/214.1 |
| 3,961,758 A | | 6/1976 | Morgan | |
| 3,975,113 A | | 8/1976 | Ogles | |
| 3,975,117 A | | 8/1976 | Carter | |
| 4,293,288 A | * | 10/1981 | Weber | 415/199.3 |
| 4,708,589 A | | 11/1987 | Nielsen et al. | |
| 4,923,367 A | * | 5/1990 | Zimmer | 415/199.1 |

* cited by examiner

*Primary Examiner*—Edward K. Look
*Assistant Examiner*—Igor Kershteyn
(74) *Attorney, Agent, or Firm*—Richard C. Litman

(57) ABSTRACT

A submersible centrifugal pump for downhole pumping of methane-saturated water from wells drilled in coal formations, has an electric motor-driven vertical shaft having centrifugal impellers distributed therealong, each impeller being located in a stationary diffuser within the pump wall to form a multi-stage pump. A concentric shroud is located at the lower portion of the pump wall. It is sealed with the pump wall such that all fluid to be pumped must enter holes near the top of the shroud and travel downward through an annulus to the pump inlet. A charge impeller and a solids grinder are located at the lower end of the pump central shaft. The multi-stage centrifugal pump is located above the solids grinder and includes multiple compression stages of diminishing volume as the methane and fluid mixture travels upward through the pump. Another charge impeller may be located at the upper end of the shaft at the outlet pipe. Pressure equalization vents allow fluid flow from the fourth centrifugal stage to the pump-shroud annulus to maintain pump prime. Centrifugal impellers, each having a hub extending upward and downward along the length of the driving shaft such as to rest upon each other in turn, while avoiding contact with the stationary diffusers.

13 Claims, 6 Drawing Sheets

CENTRIFUGAL SUBMERSIBLE PUMP

BACKGROUND OF THE INVENTION

1. Field of the Invention

The present invention relates to centrifugal submersible pumps. More particularly, the present invention relates to such a pump useful in removal of methane from a water-methane solution in a downhole well located in coal deposits.

2. Description of the Related Art

There are several problems connected with the downhole pumping of water containing dissolved methane gas from a source such as a coal field. These problems generally result in premature failure of the submerged pump. One problem is vapor lock which occurs when the flow of water is too low compared with the amount of gas present. Another is the presence of large coal particles which flow through the pump and cause damage thereto. Yet another is excessive wear in a water-coal slurry environment.

U.S. Pat. No. 4,708,589, issued Nov. 24, 1987, to Nielson et al., describes a submersible pump of the general type as the present invention. This design may be adequate for petroleum wells, but would suffer from unacceptable wear in a water pumping environment where entrained methane and coal particles are present.

U.S. Pat. No. 4,741,668, issued May 3, 1988, to Bearden, describes a submersible pump having centrifugal pump stages with abrasion resistant impeller hub. This design has the shortcoming of having rubbing parts, reducing the life of the pump, particularly in the environment of a water well having coal particles having coal particles therein.

U.S. Pat. No. 3,975,117, issued Aug. 17, 1976, to Carter describes a submersible pump having an inducer and a multistage centrifugal pump section at opposite ends of the driving motor in a pump for cryogenic or boiling fluids, particularly in a tanker ship or storage tank. This design is not appropriate where relatively large solid particles such as coal may be present in the fluid being pumped.

U.S. Pat. No. 3,975,113, issued Aug. 17, 1976, to Ogles describes a submersible pump useful for downhole pumping of water. This design is not adapted to pumping water containing high levels of methane or other gas and would be subject to damage by large particles and loss of prime by large slugs of gas.

U.S. Pat. No. 3,961,758, issued Jun. 8, 1976, to Morgan describes a submersible pump useful for pumping liquids and liquid slurries such as in a sewage collection tank, and provides a grinder at the inlet. This design would not be useful in a downhole water-methane solution environment as it is subject to vapor lock from gas slugs and subsequent loss of prime.

None of the above inventions and patents, taken either singularly or in combination, is seen to describe the instant invention as claimed. Thus a centrifugal submersible pump solving the aforementioned problems is desired.

SUMMARY OF THE INVENTION

The present invention is a submersible pump specifically designed for downhole pumping of methane-saturated water from wells drilled in coal formations. The centrifugal pump configuration has an electric motor driving a vertical shaft having centrifugal impellers distributed therealong, each impeller being located in a diffuser, stationary with regard to the pump wall to form a multi-stage pump useful in the petroleum industry, but is modified in several respects for adaptation to the specified use. Most notably, a shroud, concentric with the pump wall and forming an annulus which is sealed relative to the lower portion of the pump wall is provided such that all fluid must enter holes near the top of the shroud and travel downward through the annulus to a point below the pump inlet. A charge impeller is located near the pump inlet and above the driving motor, followed by a solids grinder to grind larger coal particles carried within the pumped fluid before entering the first centrifugal stage of the pump. The charge impeller and solids grinder are mounted on the same rotating shaft as the centrifugal impellers and turn at the same rate. The multi-stage centrifugal pump may be provided with stages of diminishing volume as the methane gas and liquid mixture becomes more and more compressed as it travels upward through the pump. Another charge impeller may be located at the upper end of the shaft at the pump outlet to boost flow upward into a vertical pipe sealed to the pump for carrying the compressed fluid to the surface for separation. Pressure equalization vents are located to allow flow of fluid from the third centrifugal stage to the annulus between the shroud and the pump wall to maintain pump prime when encountering a slug of gas in the intake. Pump stage centrifugal impellers each have a hub extending upward and downward along the length of the driving shaft such as to rest upon each other in turn, while avoiding contact with the stationary diffusers.

Accordingly, it is a principal object of the invention to provide a centrifugal submersible pump particularly adapted for pumping methane-saturated water from a well in a coal bed to the surface for separation and recovery of methane gas.

It is another object of the invention to provide a centrifugal submersible pump as above having a concentric shroud located along its lower portion and forming and annulus therewith and sealed to the pump housing both below the pump inlet and the shroud upper end wherein holes are provided near the upper end for fluid flow into the annulus and downward into the pump inlet.

It is a further object of the invention to provide a centrifugal submersible pump as above having a centrally rotating shaft extending upward from a motor and having a flow inducer located thereon in the vicinity of pump inlet openings.

Still another object of the invention is to provide a centrifugal submersible pump as above having a solids grinder located along the shaft above the flow inducer to reduce the size of any coal particles entering the pump.

Yet another object of the invention is to provide a centrifugal submersible pump as above having multiple stages reducing in volume as the pumped methane-water mixture becomes compressed due to increasing pressure as it travels upward through the pump.

Still another object of the invention is to provide a centrifugal submersible pump as above having a centrifugal impeller within each stage and wherein each impeller is keyed for rotation to the rotating shaft by a hub extending upward and downward along the shaft so as to respectively rest upon each other so as to avoid an contact with surrounding diffusers, minimizing wear of pump parts.

Yet another object of the invention is to provide a centrifugal submersible pump as above having pressure equalizer conduits communicating between the third pump stage from the bottom and the shroud-enclosed annulus to maintain pump prime when encountering slugs of gas at its intake.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a submersible pump specifically designed for downhole pumping of methane-saturated water from wells drilled in coal formations for the production of methane gas. The centrifugal pump configuration has an electric motor driving a vertical shaft having centrifugal impellers distributed along the shaft, each impeller being located in a diffuser, stationary with regard to the pump wall to form a multi-stage pump useful in the petroleum industry, but modified in several respects for adaptation to the specified use. Most notably, a gas shroud, concentric with the pump wall and forming an annulus which is sealed relative to the lower portion of the pump wall is provided such that all fluid must enter holes near the top of the shroud and travel downward through the annulus to a point below the pump inlet. This shroud assists in pumping of water saturated with methane where the methane tends to come out of solution and form gas phase bubbles, threatening the prime of the pump. Also, chunks of coal or other solids are present, threatening damage to the pump.

Figure 1:
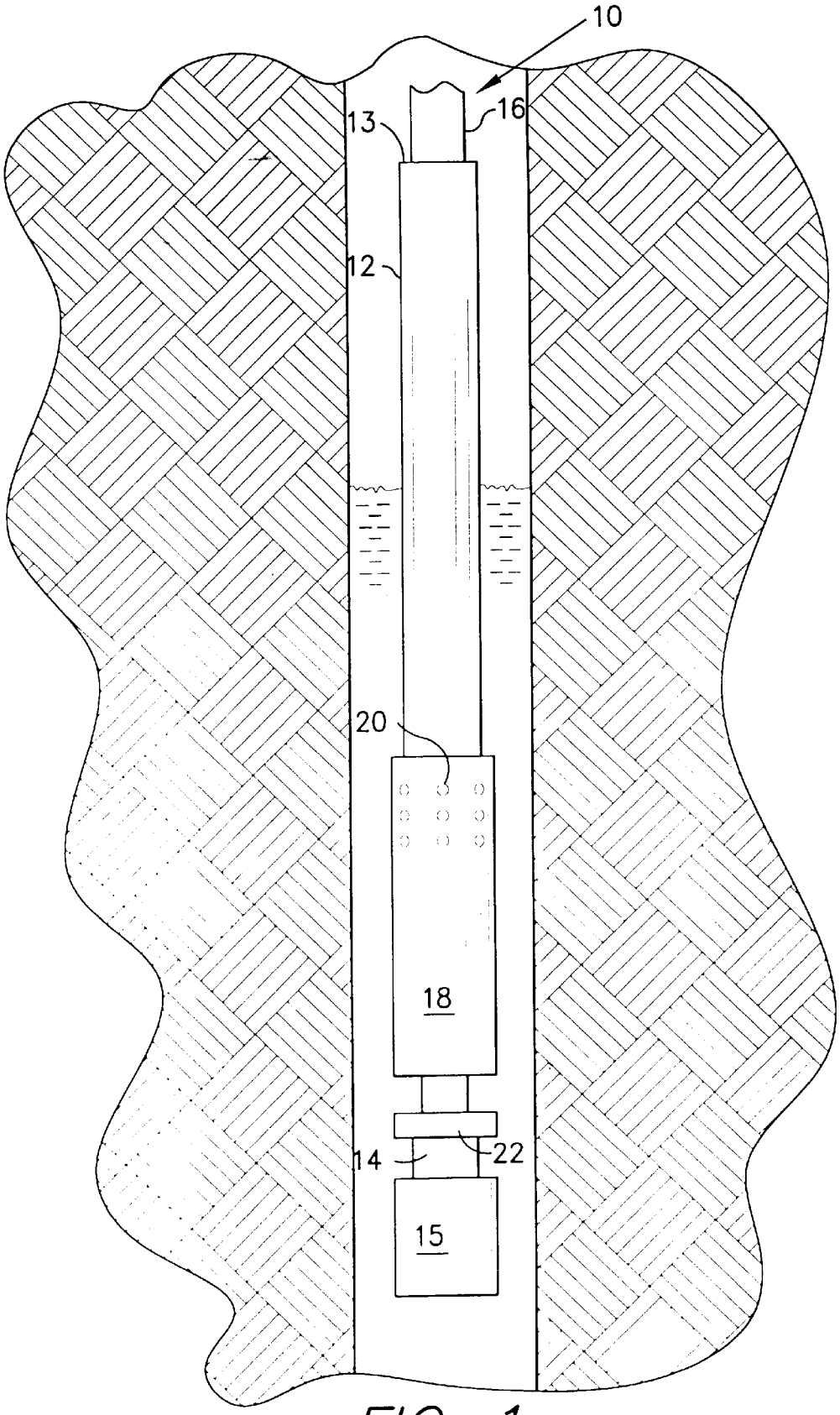
FIG. 1 is a diagrammatic environmental, perspective view of a centrifugal submersible pump according to the present invention.

Referring to FIG. 1 there is shown a coal bed methane pump of according to the present invention suspended in a standard well casing and having water level as shown. Pump 10 includes pump wall 12 having pump cap 13 and fluid exit 16 at its upper end. Shroud 18 surrounds the lower portion of casing 12 and has inlet holes 20 located in the vicinity of its upper end. Motor mount 22 is located at the lower end of pump housing 12 and attaches to a pump motor seal 14, and pump motor 15.

Figure 2:
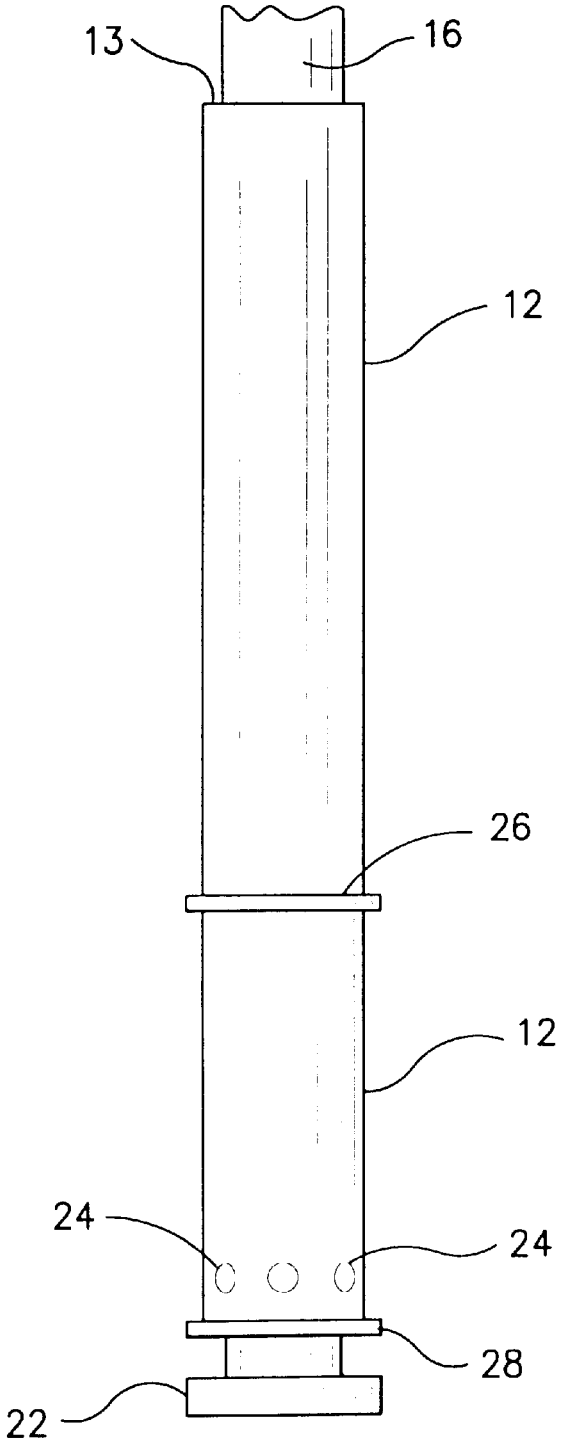
FIG. 2 is a diagrammatic elevational view of the centrifugal submersible pump of FIG. 1 with the lower shroud removed.

Referring to FIG. 2 there is shown a diagrammatic elevation view of the coal bed methane pump 10, without shroud 18, exposing pump casing inlet holes 24 near its base. Shroud upper bracket seal 26 and shroud lower bracket seal 28 are located so as to support and seal shroud 18 with pump casing 12 at the shroud's upper and lower ends, respectively. The seal are held in place relative to the shroud 18 and pump housing 12 by means of ring shaped brackets(not shown) which are mounted on the housing by screws. The shroud is so located as to extend below intake holes 24 so that any fluid entering the pump must flow into shroud intake holes 20 and down the annulus between the shroud and the pump casing to enter pump casing inlet holes 24. Each bracket seal is slotted to allow a submersible electrical cable(not shown) to pass through the shroud 18 to the motor, allowing the cable jacket to act as the sealing device for the shroud tube.

Figure 3:
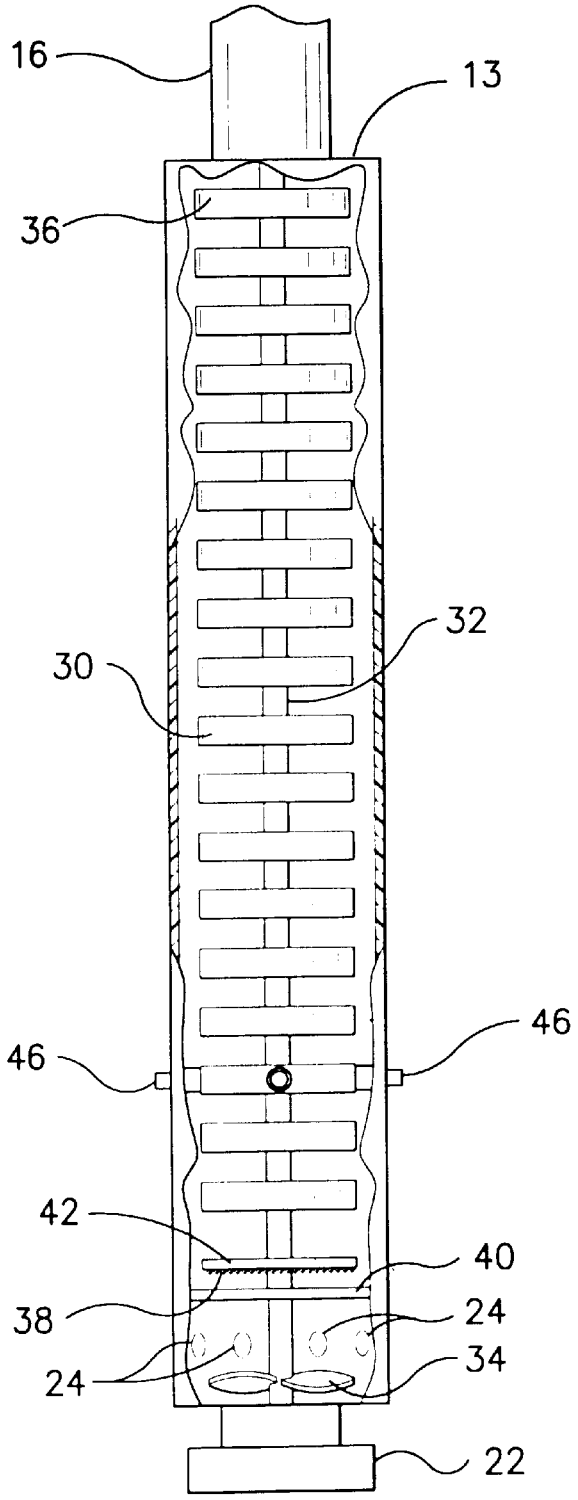
FIG. 3 is a diagrammatic elevational view of the centrifugal submersible pump of FIG. 1 with the shroud removed and the casing broken away.

Referring to FIG. 3 there is shown a diagrammatic elevation view of pump 10 having casing 12 broken away to show multi-stage compression pump stack 30 driven by central shaft 32 powered by the pump motor(not shown) connected to pump motor mount 22. Charge impeller 34 is mounted for rotation near the lower end of central shaft 32 at a point slightly below pump inlets 24 and is two-bladed open face impeller, the blades being set at an angle so as to impart upward axial momentum to the entering fluid. An optional charge impeller 36 (represented by the upper diagrammatic pump stage may be employed to assist in directing fluid into the pump outlet 16 for travel to the surface, or for entrance into another centrifugal pump, and may be of the centrifugal or two-bladed open faced type as desired. Solids grinder 38 is located on shaft 32 slightly above pump inlets 24 and consists of lower plate 40 attached to pump housing 12 and upper plate 42 spaced above plate 40 and mounted for rotation on shaft 32. Lower plate 40 has apertures(not shown) as required. One configuration would allow flow in the annulus between the lower plate 40 and the central shaft 32. Pressure equalizing plugs are located in the wall of the third pump stage from the bottom, leading from the interior of the third diffuser and through the pump housing wall to allow fluid to flow between the inside of the pump and the annulus between pump housing 12 and shroud 18 when pump pressure exceeds that in the shroud, thus maintaining pump prime when ingesting a gas slug.

Figure 4:
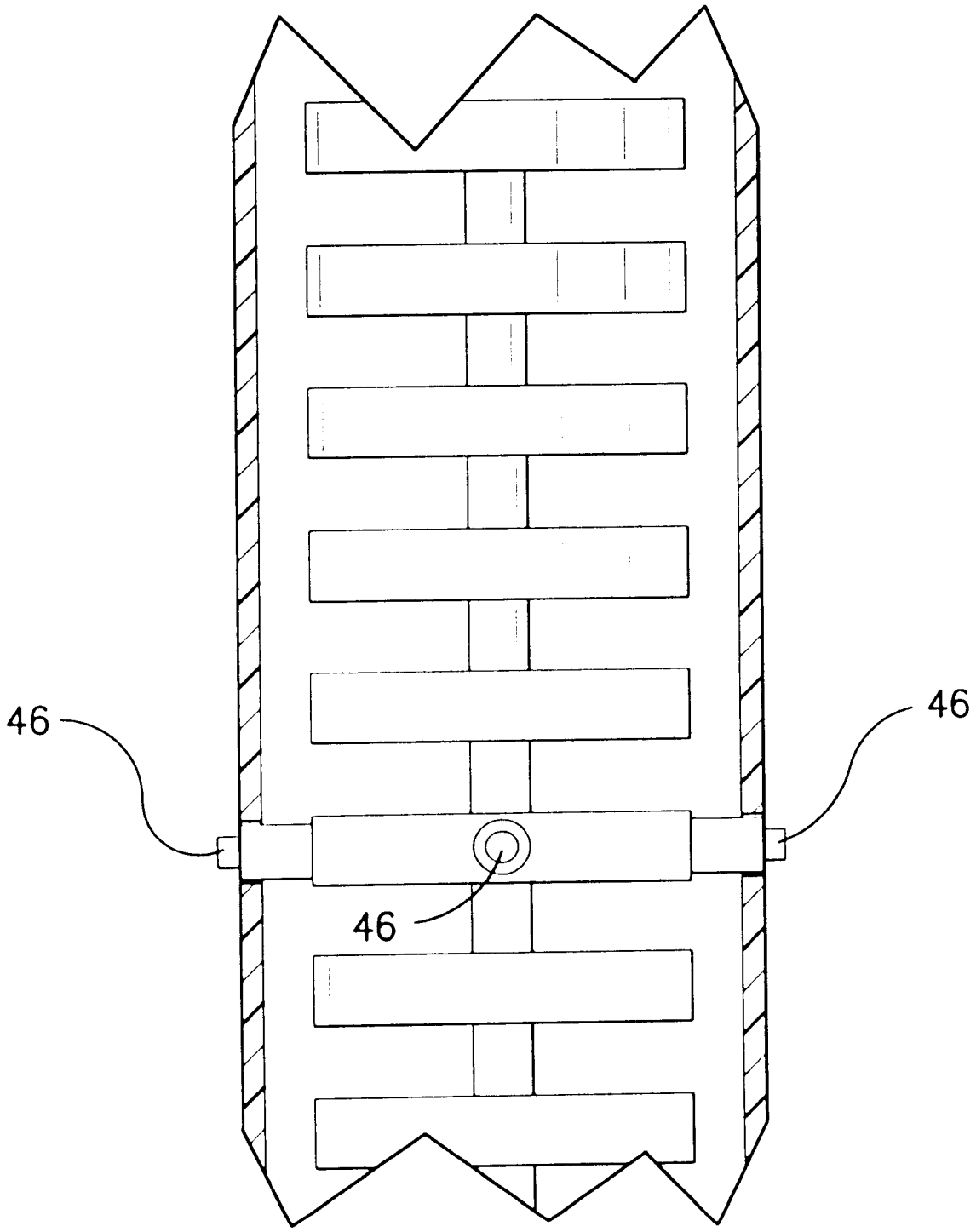
FIG. 4 is a diagrammatic detail view of the pressure equalizer within the third pump stage of FIG. 4.

Referring to FIG. 4, there is shown a detail view of FIG. 3 showing pressure equalization vent plugs 46 located in the fourth stage of multistage compression stages 30 on central shaft 32.

Figure 5:
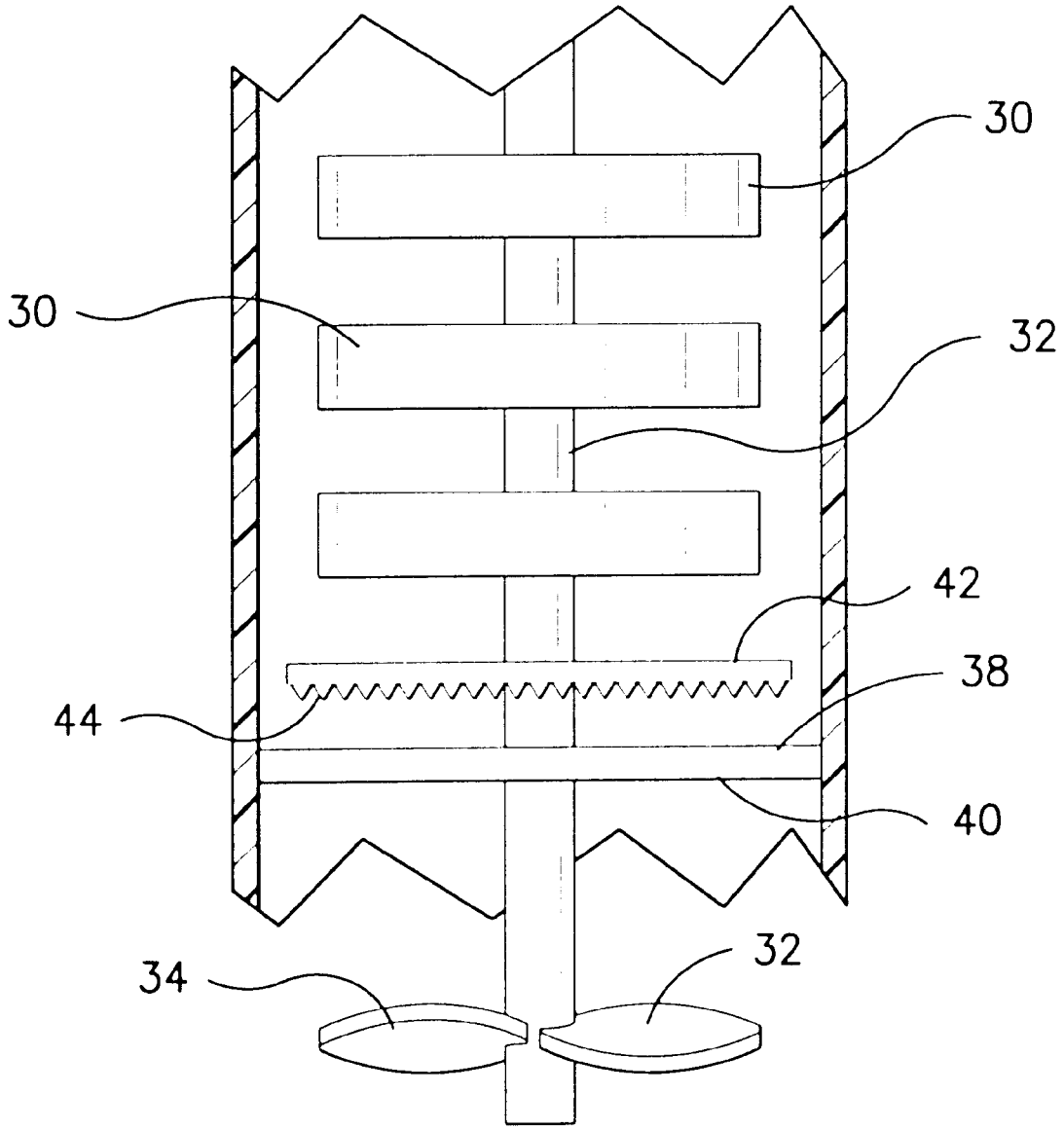
FIG. 5 is a diagrammatic detail view of the solids grinder of FIG. 4.

Referring to FIG. 5, there is shown a detail view of FIG. 3 showing the solids grinder 38 having solids grinder lower stationary plate 40 attached to the inside of pump housing 12 and upper rotating plate 42 attached for rotation with central shaft 32. Grinding teeth 44 are located on the lower surface of upper rotating plate 42 which is spaced above stationary plate 40 an appropriate distance such that grinder teeth 44 produce the desired sized coal particles from large particles entering the grinder 38.

Figure 6:
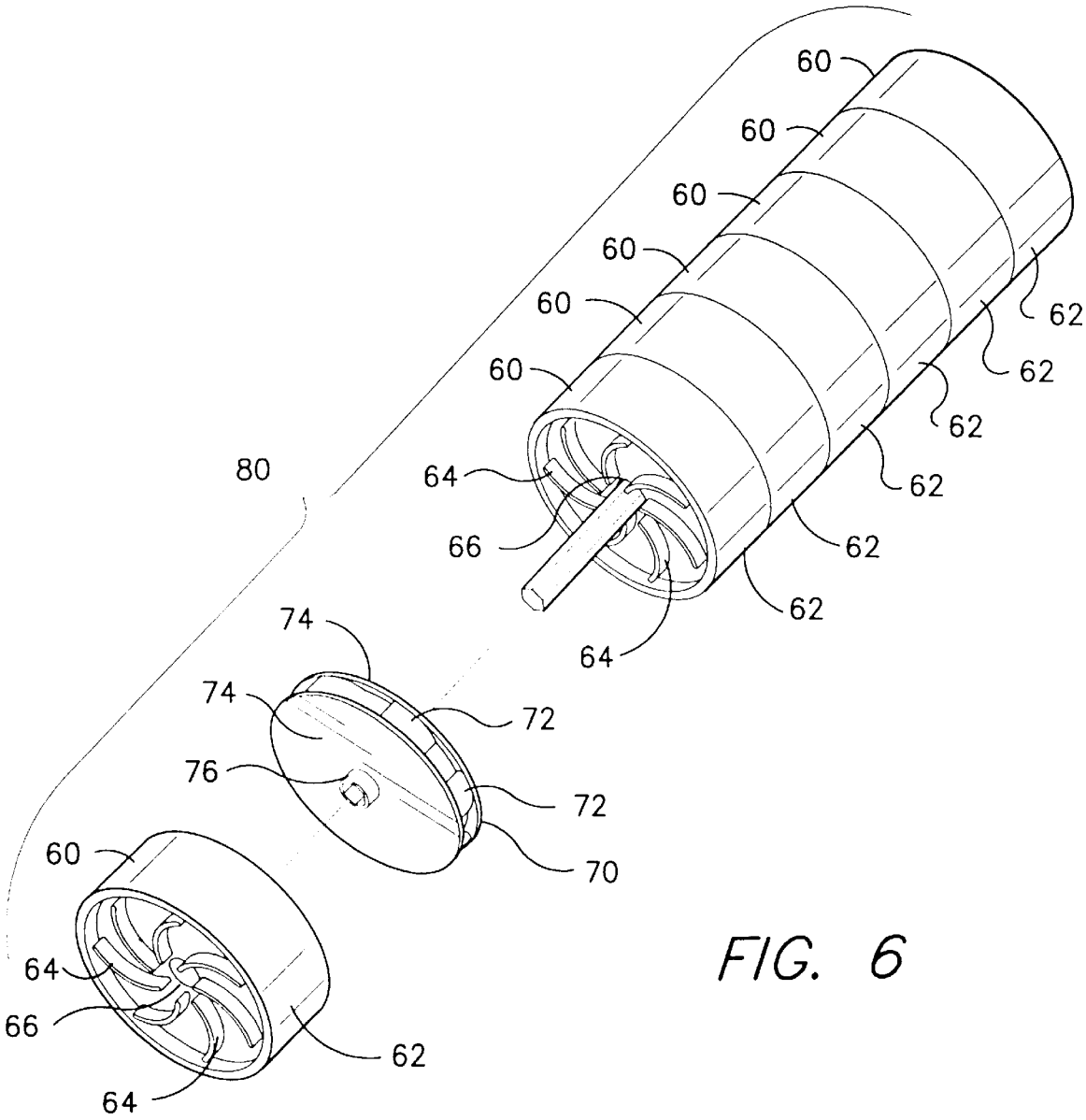
FIG. 6 is an exploded view of a group of pump stages as referred to in the diagrammatical depictions of the figures above.

Referring to FIG. 6, there is shown an exploded perspective view of a typical section of the multistage compression stages 30. Diffusers 60 comprise cylindrical walls 62 and radial vanes 64 mounted on diffuser inner plate 66 having central bore 68. The back side of diffuser 60 (not shown) is in the form of a shallow cup having the opposite side of diffuser inner plate 66 as a base and conforming with the dimensions of impeller 70 while leaving adequate mechanical clearance. Impeller 70 comprises curved radial vanes 72, similar to diffuser vanes 64, surrounded by disk-shaped shrouds 74 attached to either respective sides of vanes 72 to form water passageways which force fluid outward from the central shaft 32. There are fluid inlets on each of impellers 70 near the hub 76 in the opposing shroud 74 from that shown to allow fluid to flow from diffuser axial opening 66. Hub 76 is slidingly engaged with and keyed for rotation with central shaft 32. Hub 76 is of such length and diameter that it fits inside stationary diffuser central bore 68, while leaving space for upward liquid flow, and engages the hubs of impellers in adjoining stages(not shown). Hubs 76 are self-supporting for rotation with central shaft 32 so they are free of any physical engagement with diffusers 60. Each stack of seven impellers 70 are separated by a bearing(not shown) capable of supporting the shaft from lateral movement. The inner race portion of this bearing is attached to the central shaft for rotation and the outer race portion is held by lateral compression by the pump wall. This type of bearing is commonly used in the industry in compression pump assembly. The assembly of several stages on central shaft 32 forms a pump stage stack 80. This general type of pump configuration is standard in the industry as shown by Nielsen et al. in U.S. Pat. No. 4,708,589, granted Nov. 24, 1987 and hereby incorporated by reference. The cap structure of Nielsen et al. may be used in the present invention or, alternatively, a compression plate(not shown) forming an annulus with central shaft 32 for fluid flow and which is slidably engaged with the inner side of the pump housing 12. The compression plate presses downward against the stack of diffusers, keeping them tightly engaged. The compression plate is forced downward by screwing down pump upper cap 13 which is threadably engaged with the upper end of pump housing 12. This is also a commonly used structure in centrifugal pump design in the industry.

In operation, the water level in coal bed methane pump 10 is initially the same as water level in the surrounding well casing. As the pump rotates, methane-saturated water flows upward within well casing where it enters shroud 18 through shroud intake holes 20. The fluid then travels downward within the annulus between the shroud and the pump wall to pump inlets 24. The shroud intake holes 20 are of a size to create a pressure drop between the outside well bore pressure and annulus inside the shroud so as to induce turbulent flow through the holes 20. This results in some methane gas coming out of solution to travel up within the well casing. The shroud length is determined by the amount of water that is being produced. The volume of the annular space between the shroud and the pump wall must equal the displacement value of the pump, calculated using a well bore pressure, i.e. the pressure at the pump inlets 24, of not less than 32 psi. The number of holes in the shroud are determined such that the ratio of collective diameters of the holes to the sum of the diameters of the pump inlets 24 exceeds about 3 to 1. The holes are sized to avoid plugging due to solids, allow sufficient fluid to fall to keep the pump from running out of liquid while pumping, and to allow a pressure drop from the outside of the shroud and the inside of the shroud to promote gas separation at the hole inlets. As liquid and gas enter the pump inlets 24 they encounter charge impeller 34, a two blade, open-faced impeller, which increases the intake pressure with whatever fluids are available at the intake. This device increases lift by about 25 feet or 11 psi to charge the first stage of the compression pump with fluid. This first charge impeller will also increase the volume of fluid being pushed into the first stage, allowing any solids to be carried more quickly through the pump. The open faced, two blade charge impeller will also impact solids particles and, through impacting their surface, reducing their size. This reduction of size will allow the pump to "digest" the solids more effectively and, with the increased velocity created by the impeller, allow the solids to move more quickly to the pump, itself. The fluid then encounters the solids grinder 38 having stationary plate 40 and rotating plate 42, both of which are preferably constructed of tungsten carbide. The grinder is well suited to grind up the soft solids before they enter the pump impellers, thus increasing reliability and longevity. Both the stationary plate 40 and the pump stage diffusers 30 are held in compression with the pump housing 12. All pump stages 30 must be constructed so that the impeller hubs 76 are in constant contact and are spaced to ride in the middle of each respective diffuser 60. This construction method is known as "compression" construction. Each stack of seven impellers 70 are separated by a bearing capable of supporting the shaft from lateral movement. The inner race portion of this bearing is attached to the central shaft for rotation and the outer race portion is held by lateral compression by the pump wall. No impeller 70 or diffuser 60 may touch in either a running or non-running mode. This design allows the pump to run through the full range of its design curve without damage to the components normally caused by low flow. With the combination of materials and design, this design allows the pump to run without fluid for substantially longer periods than prior pumps before damage occurs to its components. The pump is constructed with a variety of stage volume sizes as dictated by free gas calculations. The initial stages are of larger volumetric design and placed below progressively lower volumetric design stages as the gas-liquid mixture is compressed. This design acts as an internal compression device that progressively compresses free gas into smaller and smaller bubbles until the pump can efficiently pump the combination of liquid and gas. Each stage must be built in a compression configuration without the aid of externally used pressure compensation devices.

It is to be understood that the present invention is not limited to the embodiment described above, but encompasses any and all embodiments within the scope of the following claims.

I claim:

1. A centrifugal submersible pump comprising:

a) a generally cylindrical pump casing of such diameter as to fit within a well borehole for insertion and removal of the pump;

b) a pump intake in the vicinity of a base of said pump;

c) an axial drive shaft extending substantially the length of said pump and adapted to be driven by a submersible motor located below said pump;

d) a plurality of centrifugal impellers spaced along said axial drive shaft, each of said centrifugal impellers having a central hub attached for rotation to said axial drive shaft and having an opening adjacent said drive shaft for fluid intake;

e) a plurality of diffusers corresponding, each corresponding to one of said centrifugal impellers to form a series of pump stages;

f) said diffusers being supported by inward compression of said pump housing so as to remain stationary relative to said centrifugal impellers, and having a central bore of such diameter as to allow fluid to travel upward through the annulus between said central bore and said axial drive shaft and into said impeller intake;

g) a pump outlet located and attached for flow to a conduit for receiving pumped fluid in the vicinity of an upper end of said pump housing for connection to a conduit for carrying said fluid to the surface, or into the casing of another immersible pump;

h) a cylindrical coaxial shroud located along the lower portion of said pump housing and having a plurality of fluid inlet holes located near the upper end of said shroud, said shroud being sealed at its upper end with said pump housing and at its lower end with said pump housing at a location below said pump inlet such that all intake fluid must enter said pump through said shroud.

2. The submersible centrifugal pump of claim 1, further comprising a charge impeller mounted for rotation on said axial drive shaft at a location in the vicinity of said pump inlet.

3. The submersible centrifugal pump of claim 2, wherein said charge impeller is a two blade, open-faced impeller.

4. The submersible centrifugal pump of claim 2, further comprising a plate-type solids grinder mounted for rotation on said axial drive shaft at a location above said charge impeller.

5. The submersible centrifugal pump of claim 4, wherein said plate-type solids grinder has a stationary lower disk-shaped portion located by axial compression to said pump wall, and an upper disk-shaped portion mounted for rotation with said axial drive shaft and having grinding teeth of a hardened material on a lower side of said upper rotating portion, and being spaced from said lower portion so as to grind large solids pieces into smaller ones to minimize pump wear as the pass through said pump.

6. The submersible centrifugal pump of claim 4, further comprising at least one pressure equalization vents providing for pressure equalization from a third centrifugal pump stage from the bottom of said plurality of pump stages and the annulus formed between said shroud and said pump housing so as to allow fluid to pass into said annulus when pressure, therein is low, thereby preventing loss of pump prime.

7. The submersible centrifugal pump of claim 6 further comprising a charge impeller mounted for rotation with said axial drive shaft and located at said pump outlet for providing vertical flow pressure to said fluid to enter said outlet conduit or said other pump casing.

8. The submersible centrifugal pump of claim 1 wherein said holes in said shroud have a ratio of collective diameter to pump inlets diameter of about 3 to 1.

9. The submersible centrifugal pump of claim 8 wherein said holes in said shroud each have a diameter such that turbulent flow is promoted therethrough so as to induce the formation and escape of methane gas at their respective inlets which travels upward within the well casing for collection at the surface of the well.

10. The submersible centrifugal pump of claim 1 wherein said series of pump stages are so arranged that the respective volumes of said stages decrease in ascending order so as to effectively pump water and methane gas upward as the mixed fluid is reduced in volume due to increased compression.

11. The submersible centrifugal pump of claim 1 wherein the volume of the annulus formed between said shroud and said pump housing is equal to the total volume of said immersible pump.

12. A method of pumping and separating methane-saturated water from a well located in a coal bed, comprising pumping said water upward and around an annulus formed by a casing of said well and a pump, reversing flow of said water to enter holes in the upper end of an annulus formed by the lower portion of a pump housing and a shroud sealingly engaged therewith at its upper and lower end, so as to induce turbulent flow through said holes then inducing partial separation of methane from said methane-saturated water which separated methane travels upward within the well casing for collection at the surface thereof.

13. The method of claim 12 wherein a mixture of gas-phase and methane-containing water, along with solids is subjected to grinding and compression pumping through a multi-stage centrifugal pump for economic delivery of compressed water and methane gas mixture to the well surface for separation to recover methane.

* * * * *